US010496039B2

(12) United States Patent
Kruttli et al.

(10) Patent No.: US 10,496,039 B2
(45) Date of Patent: Dec. 3, 2019

(54) DEVICE FOR A TIMEPIECE

(71) Applicant: PATEK PHILIPPE SA GENEVE, Geneva (CH)

(72) Inventors: Anthony Kruttli, Orchamps-Vennes (FR); David Chabloz, Annecy (FR)

(73) Assignee: PATEK PHILIPPE SA GENEVE, Geneva (CH)

( * ) Notice: Subject to any disclaimer, the term of this patent is extended or adjusted under 35 U.S.C. 154(b) by 307 days.

(21) Appl. No.: 15/122,562

(22) PCT Filed: May 13, 2015

(86) PCT No.: PCT/EP2015/060713

§ 371 (c)(1),
(2) Date: Aug. 30, 2016

(87) PCT Pub. No.: WO2015/173372

PCT Pub. Date: Nov. 19, 2015

(65) Prior Publication Data

US 2017/0068223 A1 Mar. 9, 2017

(30) Foreign Application Priority Data

May 15, 2014 (EP) ..... 14168485

(51) Int. Cl.
*G04F 7/08* (2006.01)
*G04B 11/00* (2006.01)

(52) U.S. Cl.
CPC ..... *G04F 7/08* (2013.01); *G04B 11/00* (2013.01); *G04F 7/0828* (2013.01)

(58) Field of Classification Search
CPC ..... G04F 7/08; G04F 7/0828; G04F 7/0847; G04B 11/00
See application file for complete search history.

(56) References Cited

U.S. PATENT DOCUMENTS 4,445,783 A * 5/1984 Dodane ..... G04F 7/0847 368/105
2004/0246820 A1 12/2004 Girardin
(Continued)

FOREIGN PATENT DOCUMENTS

EP 1 296 205 A1 3/2003
EP 1 430 367 B1 4/2008
(Continued)

OTHER PUBLICATIONS

International Search Report, dated Dec. 2, 2015, from corresponding PCT Application.

*Primary Examiner* — Sean P Kayes
*Assistant Examiner* — Jason M Collins
(74) *Attorney, Agent, or Firm* — Young & Thompson

(57) ABSTRACT

A shock absorbing coupling device for a timepiece, includes a coupling wheel (2) able to take a coupled position and an uncoupled position, a coupling member (1) bearing the coupling wheel and a coupling cam (6) engaging with the coupling member (1) to define the coupled position and uncoupled position of the coupling wheel (2). The device also includes a locking member (12) rigidly attached to the coupling cam (6) and an intermediate member (9) controlled by the coupling member (1). The intermediate member (9) is intended to engage with the coupling member (1) and the locking member (12) to prevent or limit the movement of the coupling member (1) under the effect of a shock when the coupling wheel (2) is in the coupled position, to thus avoid the coupling wheel (2) leaving the coupled position.

17 Claims, 6 Drawing Sheets

(56) References Cited

U.S. PATENT DOCUMENTS

| | | | | |
|---|---|---|---|---|
| 2011/0002198 | A1* | 1/2011 | Wyssbrod ..... | G04B 43/002<br>368/287 |
| 2012/0069717 | A1 | 3/2012 | Mertenat | |

FOREIGN PATENT DOCUMENTS

| | | | |
|---|---|---|---|
| EP | 2 228 692 | A1 | 9/2010 |
| JP | 2899967 | B1 | 6/1999 |

* cited by examiner

DEVICE FOR A TIMEPIECE

This invention relates to a device for a timepiece comprising a movable element that can assume multiple specified positions under the action of a control cam. More particularly, this invention relates to a coupling device, in particular for a chronograph.

In a chronograph, a coupling device makes it possible to transmit the movement of a moving object of the going train to the chronograph wheel that carries the chronograph hand. The coupling device comprises a coupling wheel that can occupy an coupled position, corresponding to the operating position of the chronograph, where the chronograph wheel is driven by a moving object of the going train via the coupling wheel, and a uncoupled position, corresponding to the stop position of the chronograph, where the chronograph wheel is not driven by a moving object of the going train via the coupling wheel.

A coupling lever carrying the coupling wheel works with a control element to move the coupling wheel into its coupled and uncoupled positions. Jumpers, springs, and stops ensure that the elements of the coupling device are in their coupled position or uncoupled position, in particular when the chronograph is in operation.

However, a sudden movement or a shock creating a greater force than the return force exerted by the control spring of the coupling lever can bring about a movement of the coupling lever and thus a movement of the coupling wheel. The entrainment of the chronograph wheel can then be interrupted for a moment, distorting the measurement.

The object of this invention is to produce a device for a timepiece comprising a movable element that can assume at least two specified positions and that makes it possible to prevent said movable element from leaving one of its specified positions under the action of a shock. In particular, an object of this invention is to produce a coupling device for a timepiece and in particular for a chronograph making it possible to solve the above-described problem and to prevent the inadvertent disengagement of the coupling device in the event of a shock or a sudden movement and consequently to guarantee the measurement.

For this purpose, this invention has as its object a device for a timepiece comprising a movable element that can assume at least two specified positions and a control cam working with said movable element to define said at least two specified positions, characterized by the fact that the device also comprises a locking element that is integral with the control cam and an intermediate element controlled by the movable element and designed to work with the locking element to prevent or to limit the movement of said movable element under the action of a shock when the movable element is in one of these specified positions, thus preventing said movable element from leaving its specified position.

This invention also has as its object a chronograph mechanism according to Claim 17 as well as a timepiece according to Claim 18.

Other characteristics and advantages of this invention will emerge from reading the following detailed description of an embodiment of the invention to which reference is made in the accompanying drawings in which.

In the embodiment illustrated in FIGS. 1 to 6, the device for a timepiece according to the invention is a coupling device for a chronograph.

The coupling device according to the illustrated embodiment of the invention comprises a coupling lever 1 pivoted at A (for example on a bridge or on the movement plate comprising the chronograph mechanism) and carrying a coupling wheel 2. The coupling wheel 2 is permanently meshed with a moving object of the base movement of the timepiece. In this embodiment, the driving of the coupling wheel 2 by the base movement is done via the driving wheel 3 that is also pivoted at A. This driving wheel 3 is connected to the going train (for example to the seconds-wheel) of the movement in a conventional manner.

Figure 1:
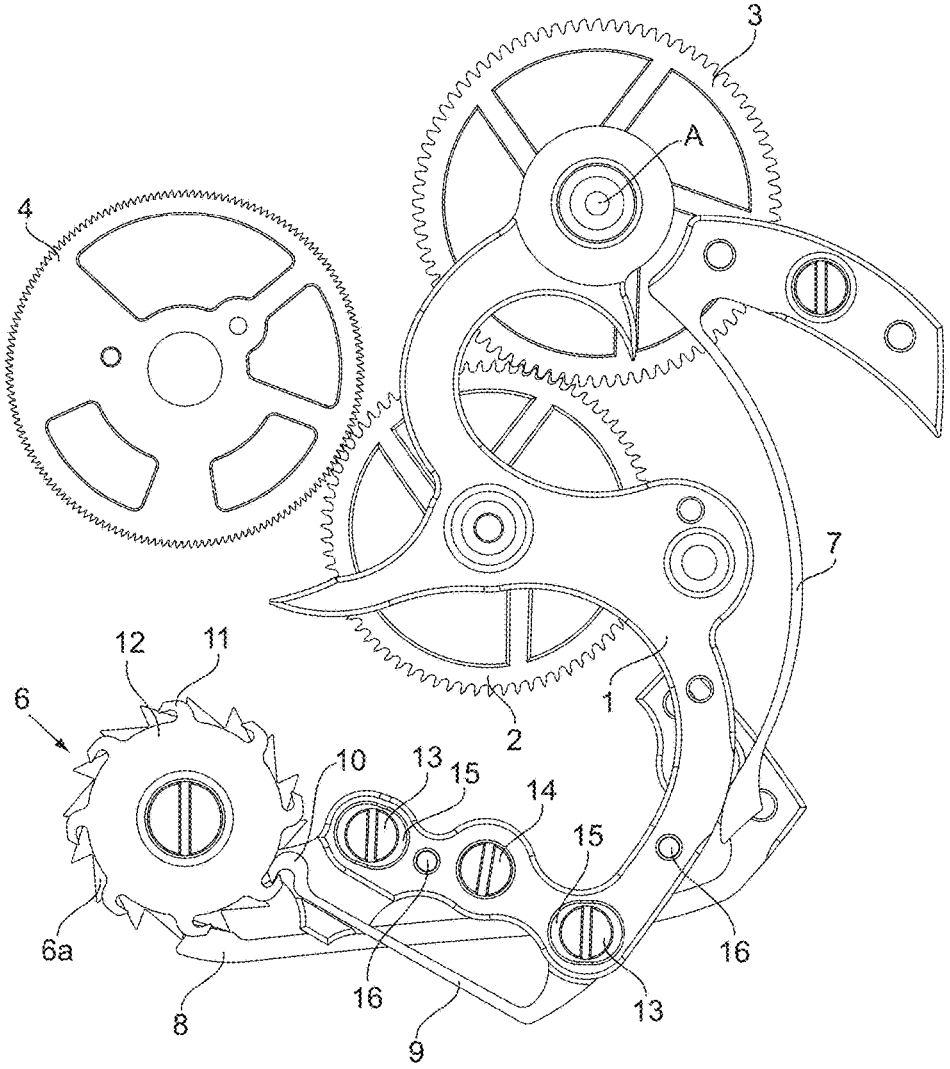
FIG. 1 is a top view of a coupling device according to an embodiment of the invention in a coupled position.
Figure 2:
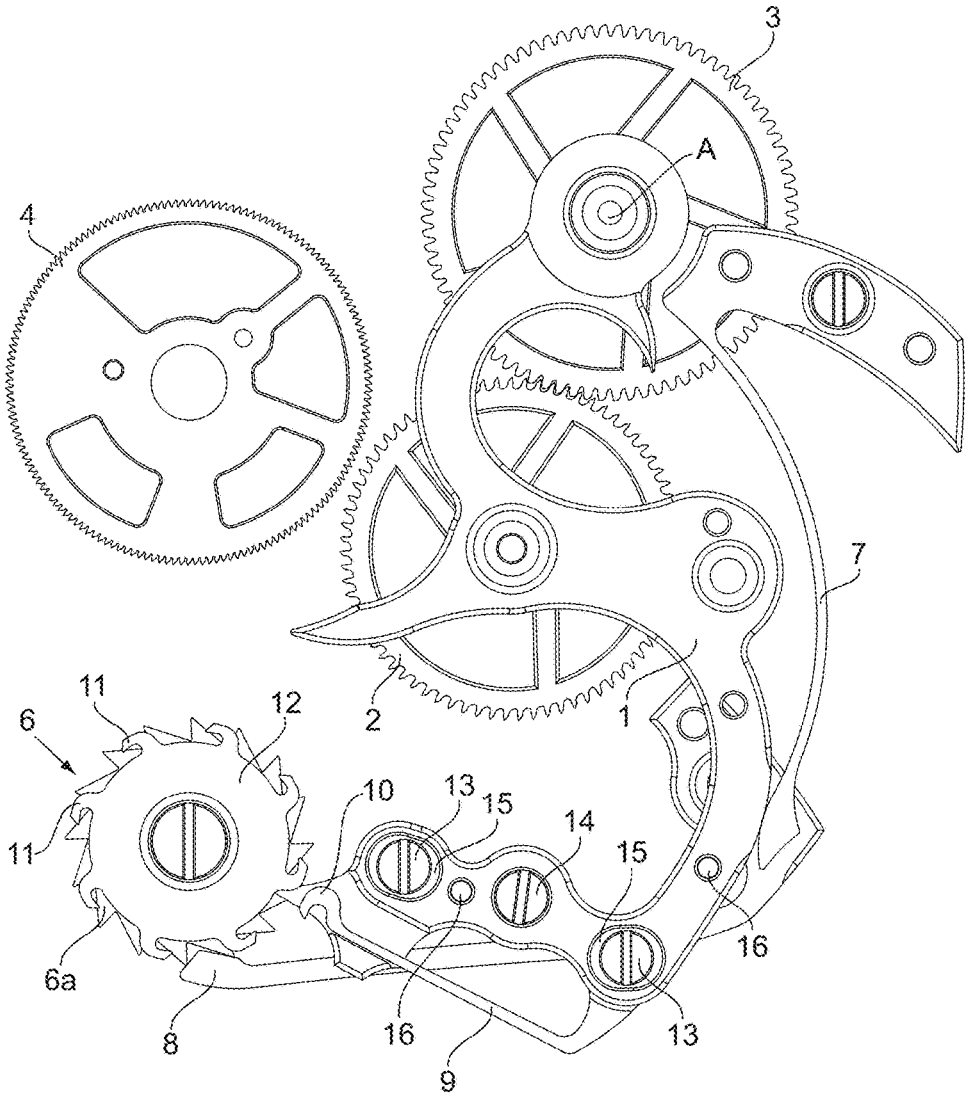
FIG. 2 is a top view of a coupling device according to an embodiment of the invention in an uncoupled position.

The coupling lever 1 pivots at A between a first position, illustrated in FIG. 1 and in which the coupling wheel 2 is in a coupled position meshed with a chronograph wheel 4 of the chronograph mechanism, and a second position, illustrated in FIG. 2 and in which the coupling wheel 2 is in an uncoupled position and is not meshed with said chronograph wheel 4. Thus, when the coupling lever 1 is in its first position, the chronograph is in operation, whereas when the coupling lever 1 is in its second position, the chronograph is stopped.

At one of its ends, the coupling lever 1 has a beak 5 (FIGS. 3 and 4) designed to work with a control cam 6 of the coupling device for the positioning of said coupling lever 1. In the illustrated embodiment, the control cam is a column wheel 6. In a traditional manner, the column wheel 6 comprises a toothing 6*a* and columns 6*b* (FIGS. 3 and 4) arranged perpendicularly and in a concentric way to the toothing 6*a*. A column wheel jumper 8 works with the toothing 6*a* to determine the stable and precise positions of the column wheel 6. The chronograph also comprises a chronograph control device (not illustrated) working with the toothing 6*a* for driving the column wheel 6.

The coupling lever 1 is subjected to the action of a lever spring 7 that makes it possible to move the lever 1 and that tends to keep it in contact with the column wheel 6. In the coupled position shown in FIGS. 1 and 4, the beak 5 of the coupling lever 1 is engaged between two columns 6*b* of the column wheel 6.

According to an essential aspect of the invention, the coupling lever 1 also controls an arm 9. In the illustrated embodiment, the arm 9 is attached to the coupling lever 1. The free end of the arm 9 has the shape of a first hook 10. The arm 9 and the first hook 10 are arranged to work with a locking element that is integral with the column wheel 6. In the illustrated embodiment, the locking element is a hook wheel 12 having hooks 11 that are radially distributed on its circumference.

Figure 4:
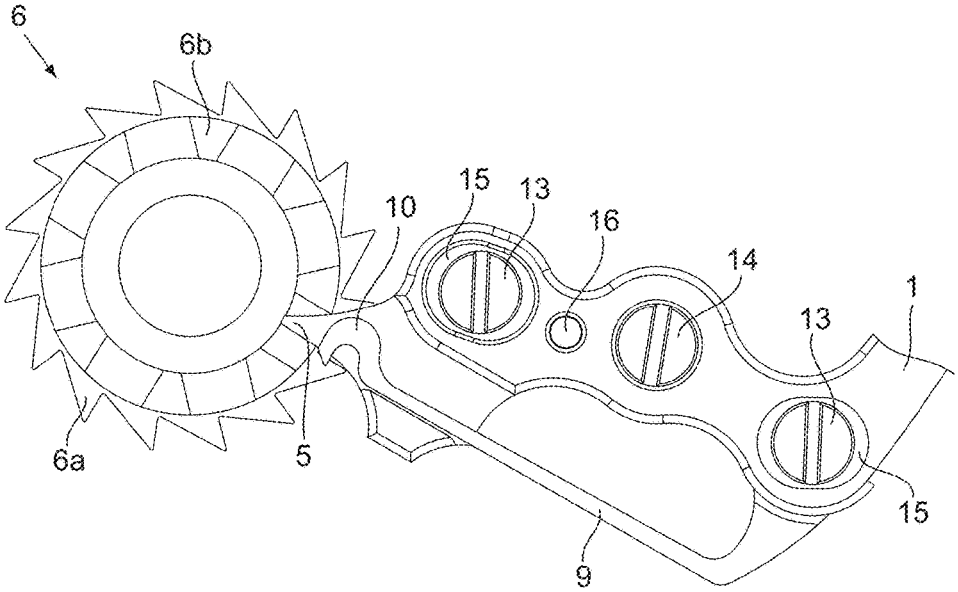
FIG. 4 illustrates in particular the column wheel and the coupling lever of the device according to an embodiment of the invention in a coupled position just before the return to the uncoupled position.

In the coupled position illustrated in FIGS. 1 and 4, the beak 5 of the coupling lever 1 is engaged between two columns 6*b* of the column wheel 6. The coupling wheel 2 is thus meshed with the chronograph wheel 4. The hook wheel 12 and the arm 9 are shaped so that in this coupled position, the first hook 10 of the arm 9 works with a second hook 11 of the hook wheel 12 and blocks or limits the movement of the coupling lever 1 in its first position in which the coupling wheel 2 is in the coupled position and is meshed with the chronograph wheel 4 when a shock tends to move said lever 1 against the action of its lever spring 7. In addition, in this coupled position, the first hook 10 of the arm 9 also abuts between two hooks 11 of the hook wheel 12 and precisely positions the coupling wheel 2 so that it is correctly meshed with the chronograph wheel 4.

Figure 3:
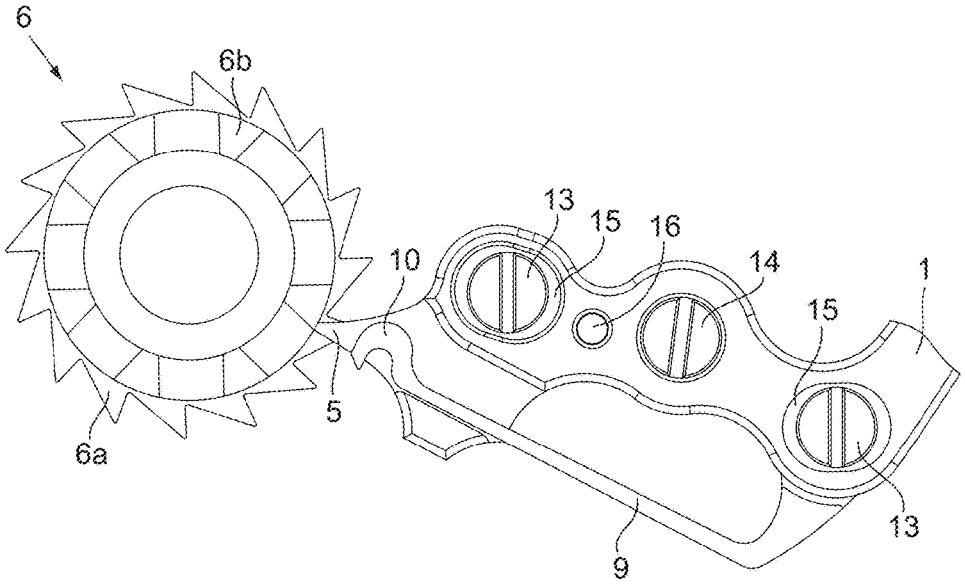
FIG. 3 illustrates in particular the column wheel and the coupling lever of the device according to an embodiment of the invention in an uncoupled position.

In the uncoupled position illustrated in FIGS. 2 and 3, the beak 5 of the coupling lever 1 rests against a column 6*b* of the column wheel 6. The coupling wheel 2 is no longer meshed with the chronograph wheel 4. In this position, the hook wheel 12 and the arm 9 do not work together.

In the illustrated embodiment, the hook wheel 12 has as many second hooks 11 as there are columns 6*b* on the column wheel 6.

From the coupled position of the coupling wheel 2 illustrated in FIGS. 1 and 4, the actuating of the control device of the chronograph (not illustrated) entrains the pivoting of the column wheel 6 clockwise. Since the hook wheel 12 is integral with the column wheel 6, it therefore pivots simultaneously with the former and releases the first hook 10 from the arm 9 of the coupling lever 1 before the column 6*b* of the column wheel 6 comes into contact with the beak 5 of the coupling lever 1 to make the latter pivot to return to its uncoupled position in a conventional manner.

From the uncoupled position illustrated in FIGS. 2 and 3, the actuating of the control device of the chronograph (not illustrated) entrains the pivoting clockwise of the column wheel 6. The beak 5 of the coupling lever 1 then drops into a space between two columns 6*b* of the column wheel 6. By so doing, the first hook 10 of the arm 9 abuts against a second hook 11 of the hook wheel 12 that pivoted simultaneously with the column wheel 6. The first and second hooks 10, 11 each have a first inclined flank 100, 110. When said hooks come into contact, said inclined flanks 100, 110 are shaped so that they slide over one another, entraining the movement of the first hook 10 by elastic deformation of the arm 9 until said first hook 10 regains a position in which it works with the second hook 11 to hold the coupling lever 1.

The hook wheel 12, the arm 9 and its first hook 10 are therefore shaped to work together when the coupling lever 1 is in its first coupled position in such a way as to limit or to prevent any movement of said lever 1 against the action of its lever spring 7 under the action of a shock that would tend to make it return to its uncoupled position. Thus, even in the event of a shock creating a greater force than the force of the lever spring 7, the coupling lever 1 is held in its first position by the hook wheel 12, and the coupling wheel 2 remains meshed with the chronograph wheel 4 without interrupting the measurement. In addition, when the column wheel 6 pivots from a first stable position corresponding to the coupled position of the coupling wheel 2 to a second stable position corresponding to the uncoupled position of the coupling wheel 2, the hook wheel 12 pivots simultaneously with the column wheel 6 in such a way as to release the first hook 10 before the column wheel 6 raises the coupling lever 1 and thus makes it possible for the coupling lever 1 to return to its second position in which the coupling wheel 2 is in the uncoupled position.

Figure 5:
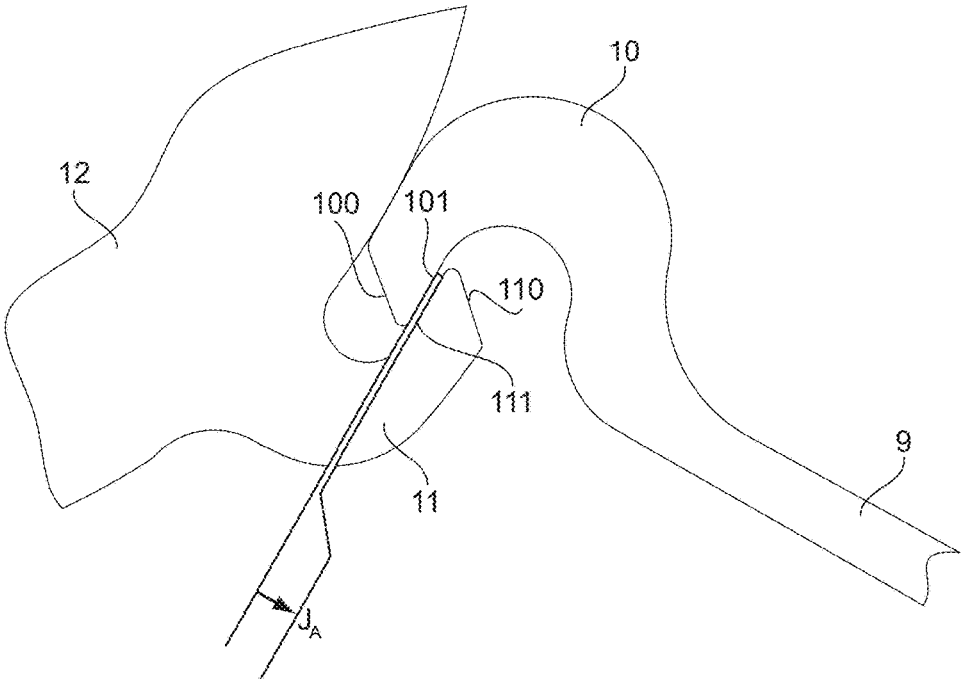
FIGS. 5 and 6 illustrate variants of the shape of the hooks of the device according to the invention.

In a first variant illustrated in FIG. 5, the second hooks 11 of the hook wheel 12 have such a shape that an operational play $J_A$ exists between said hooks 11 and the first hook 10 of the arm 9 when the latter work together in the coupled position of the device. To prevent any disengagement of the coupling wheel 2 and the chronograph wheel 4 in the event of a shock, the parts are sized in such a way that said operational play $J_A$ makes it possible to guarantee the penetration of the teeth of the coupling wheel 2 in relation to the teeth of the chronograph wheel 4. In this first variant illustrated in FIG. 5, the inside flanks 111, 101 respectively of the second hooks 11 of the hook wheel 12 and the first hook 10 of the arm 9 are essentially parallel.

Figure 6:
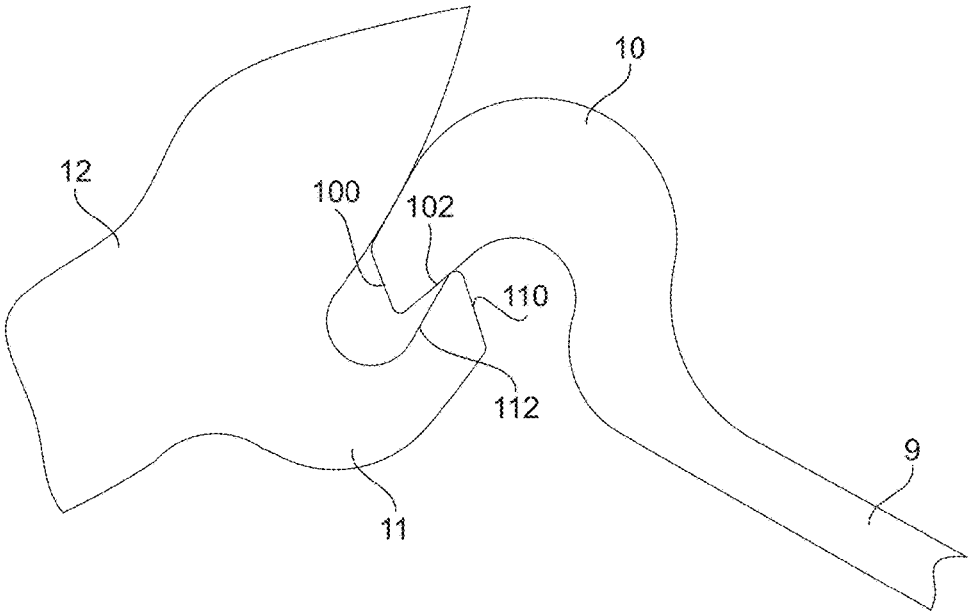

In a second variant illustrated in FIG. 6, the second hooks 11 of the hook wheel have a shape such that there is no operational play between said hooks 11 and the first hook 10 of the arm 9 when said hooks work together in the coupled position of the device. As illustrated in FIG. 6, in this variant, the second hooks 11 of the hook wheel 12 and the first hook 10 of the arm 9 each have an inclined inside flank 112, 102 such that the contact between said first and second hooks 10, 11 is always made at two points in the first coupled position of the lever 1. In this variant, the shock resistance of the device depends on the slope of the inclined inside flanks 102, 112 of the first and second hooks 10, 11.

In the illustrated embodiment, the arm 9 is positioned on the coupling lever 1 by two guide pins 16 and held by two holding screws 13 each screwed through a corresponding groove 15 into the coupling lever 1. An eccentric 14 makes it possible to move the first hook 10 of the arm 9 in relation to the coupling lever 1. The adjustment of the coupling device and in particular the penetration of the teeth of the coupling wheel 2 in relation to the teeth of the chronograph wheel 4 is then done as follows: in the coupled position of the coupling wheel 2, with the beak 5 of the coupling lever 2 being located between two columns 6*b* of the column wheel 6 and the end of the arm 9 abutting the hook wheel 12, the holding screws 13 are first loosened; the eccentric 14 is then rotated, if necessary, driving the movement of the arm 9 to adjust the position of the lever 1 and therefore of the coupling wheel 2. Once the desired position is found, the holding screws 13 are retightened. The coupling lever 1 and its arm 9 are then perfectly adjusted.

The embodiment above was described by way of example. In particular, the chronograph mechanism is well known to one skilled in the art and can comprise any other traditional device (control, resetting, . . . ) without a connection to the invention. Likewise, the invention is limited neither to a coupling device for a chronograph nor to a coupling mechanism.

In the above-described embodiment, the arm 9 is elastically deformable and is carried by the coupling lever. As a variant, said arm could be a rigid finger that is movable in rotation and subjected to the action of a suitable elastic force such as a spring. Said finger could be pivoted on the coupling lever. It could also be pivoted elsewhere on the movement and be arranged to be controlled by said lever and to work with said lever and with the hook wheel in such a way that when said lever is in its coupled position, said finger prevents or limits any movement of the lever under the action of a shock.

In a general manner, the invention relates to a device for a timepiece comprising a movable element that can assume at least two specified positions and a control cam that works with said movable element to define said at least two specified positions. The device also comprises a locking element that is integral with the control cam and an intermediate element that is controlled by the movable element. The intermediate element is designed to work with the locking element to prevent or to limit the movement of said movable element under the action of a shock when the movable element is in one of its specified positions, thus preventing said movable element from leaving its specified position.

A multi-positional device, such as, for example, a coupling device, which withstands shocks and whose operational safety and precision are improved, while remaining simple and easy to adjust, is thus produced.

The invention claimed is:

1. A device for a timepiece comprising a movable element (1) that can assume at least two specified positions and a coupling cam (6) working with said movable element (1) to define said at least two specified positions, wherein the device also comprises a hook wheel (12) that is integral with the coupling cam (6) and an intermediate element (9) controlled by the movable element (1) and designed to work with the hook wheel (12) to prevent or to limit the movement of said movable element (1) under the action of a shock when the movable element (1) is in one of its specified positions, thus preventing said movable element (1) from leaving its specified position, wherein the movable element (1) carries a coupling wheel (2) that can assume a coupled position and an uncoupled position, and wherein the coupling cam works with the movable element (1) to define the coupled position and the uncoupled position of the coupling wheel (2).

2. The device for a timepiece according to claim 1, wherein the movable element is a coupling element (1).

3. The device for a timepiece according to claim 1, wherein the intermediate element (9) is carried by the movable element (1) and works with the locking element for preventing or limiting the movement of the movable element (1) under the action of a shock when the coupling wheel (2) is in its coupled position, thus preventing the coupling wheel (2) from leaving its coupled position.

4. The device for a timepiece according to claim 1, wherein the coupling cam is a column wheel (6).

5. The device for a timepiece according to claim 4, wherein the hook wheel (12) has as many hooks (11) as there are columns (6*b*) on the column wheel (6).

6. The device for a timepiece according to claim 1, wherein the hook wheel (12) is coaxial to the coupling cam (6).

7. The device for a timepiece according to claim 1, wherein the intermediate element is an arm (9) whose end has the shape of a hook (10).

8. The device for a timepiece according to claim 7, wherein the hook (10) of the arm (9) and the hooks (11) of the hook wheel (12) are shaped in such a way that an operational play exists between said hooks when they work together to limit the movement of the movable element (1) under the action of a shock when the coupling wheel (2) is in its coupled position.

9. The device for a timepiece according to claim 8, wherein the hook (10) of the arm (9) and the hooks (11) of the hook wheel (12) each have essentially parallel inside flanks (101, 111) when said hooks work together.

10. The device for a timepiece according to claim 7, wherein the hook (10) of the arm (9) and the hooks (11) of the hook wheel (12) each have an inclined inside flank (102, 112) in such a way that no operational play exists between said hooks when they work together to prevent the movable element (1) from being moved under the action of a shock.

11. The device for a timepiece according to claim 1, wherein the intermediate element is arranged so that its position can be adjusted in relation to the position of the movable element (1).

12. The device for a timepiece according to claim 1, wherein the intermediate element (9) is guided by two guide pins (16) and is attached to the movable element (1) by at least one holding screw (13) that passes through an opening (15) of said movable element (1) in such a way that the coupled position of the coupling wheel (2) can be adjusted.

13. The device for a timepiece according to claim 1, further comprising an eccentric (14) for adjusting the position of the intermediate element (9) in relation to the movable element (1) in such a way that the coupled position of the coupling wheel (2) can be finely adjusted.

14. A chronograph mechanism comprising the device according to claim 1.

15. A timepiece comprising the device according to claim 1.

16. A device for a timepiece comprising a movable element (1) that can assume at least two specified positions and a control cam (6) working with said movable element (1) to define said at least two specified positions, wherein the device also comprises a locking element (12) that is integral with the control cam (6) and an intermediate element (9) controlled by the movable element (1) and designed to work with the locking element (12) to prevent or to limit the movement of said movable element (1) under the action of a shock when the movable element (1) is in one of its specified positions, thus preventing said movable element (1) from leaving its specified position, and wherein the intermediate element is arranged so that its position can be adjusted in relation to the position of the movable element (1).

17. A device for a timepiece comprising a movable element (1) that can assume at least two specified positions and a control cam (6) working with said movable element (1) to define said at least two specified positions, wherein the device also comprises a locking element (12) that is integral with the control cam (6) and an intermediate element (9) controlled by the movable element (1) and designed to work with the locking element (12) to prevent or to limit the movement of said movable element (1) under the action of a shock when the movable element (1) is in one of its specified positions, thus preventing said movable element (1) from leaving its specified position, wherein the movable element (1) carries a coupling wheel (2) that can assume a coupled position and an uncoupled position, and wherein the intermediate element (9) is guided by two guide pins (16) and is attached to the movable element (1) by at least one holding screw (13) that passes through an opening (15) of said movable element (1) in such a way that the coupled position of the coupling wheel (2) can be adjusted.

* * * * *